United States Patent [19]

Gregory et al.

[11] Patent Number: 4,721,218

[45] Date of Patent: Jan. 26, 1988

[54] TAMPER INDICATING PACKAGE

[75] Inventors: James L. Gregory, Toledo; Steven R. Wolfe, Maumee, both of Ohio

[73] Assignee: Owens-Illinois Closure Inc., Toledo, Ohio

[21] Appl. No.: 15,764

[22] Filed: Feb. 17, 1987

[51] Int. Cl.[4] ..... B65D 41/34

[52] U.S. Cl. ..... 215/252; 215/258

[58] Field of Search ..... 215/252, 258

[56] References Cited

U.S. PATENT DOCUMENTS 4,461,390 7/1984 Csaszar ..... 215/252

4,613,052 9/1986 Gregory et al. ..... 215/252

*Primary Examiner*—Donald F. Norton

*Attorney, Agent, or Firm*—H. G. Bruss

[57] ABSTRACT

A tamper indicating package comprising a one-piece molded closure of plastic which threads onto a container such that when the closure is unthreaded, a tamper-indicating ring becomes separated from the lower end of the closure skirt. The indicating ring or band is joined to the closure along a weakened frangible line and a flexible stop ring is formed within the band and extends inwardly and upwardly when the closure is applied to a container finish. The container finish has a first radial bead, a second radial bead spaced axially below the first bead, and an intermediate tapered or concave surface between the first radial bead and second radial bead. A further surface extends from the second bead axially downwardly and radially inwardly and the flexible end of the stop ring rests on this surface between the two beads, when the closure is applied. When the closure is unthreaded to remove it, the free end of the stop ring passes over the second bead into the recess formed by the surface between the two beads and the frangible portion is broken leaving the ring and band in this position. Upon subsequent reapplication of the closure, the closure skirt engages the band causing the band to pass over the second bead on the finish so that the band falls away but remains on the container to indicate that the band has been severed.

6 Claims, 12 Drawing Figures

TAMPER INDICATING PACKAGE

BACKGROUND OF THE INVENTION

The present invention is directed to a one-piece, molded plastic, or the like, closure that may be threaded onto the finish or neck of a container, and in which a tamper-indicating band is joined to the bottom of the closure skirt by a series of frangible bridges. An inwardly and upwardly turned flexible, stop band is molded inside the indicator band and in combination with a radial bead on the container finish will resist removal of the closure without rupture of the frangible bridges.

Tamper-indicating closures are not new and one recently patented example can be found in U.S. Pat. No. 4,394,918 issued to Jean Grussen on July 26, 1983. In this patent a threaded closure carries a hold ring that is joined to the bottom of the cap skirt by a series of breakable tabs and the hold ring has an inside diameter that is at least equal to the outside diameter of the cap skirt. A plurality of lock lugs supported on the ring are inclined upwardly and inwardly and are intended to hook behind a collar or mating ring on the container neck to prevent the hold ring from being lifted off the container neck when the cap is unscrewed. An unbreakable flange is provided between the cap skirt and the ring and serves as a hinge for the cap when it is unscrewed.

Other tamper-indicating closures that thread on the containers are made fairly simple, but these tamper-indicating rings generally require cooperating, specifically designed, means on the container.

Some other tamper-indicating systems have been used in which a frangible band is formed at the bottom of the closure skirt and requires the actual destruction of the band before the closure can be unscrewed. These also may require special ramps and ledges to be formed on the container shoulders or necks. The problem with these systems is that once the band is removed and discarded, it may not be readily apparent that the closure has been unscrewed.

Much of the same can be said for the systems that use heat shrunk or stretch bands that engage the closure and the container. Furthermore, heat shrinking adds an additional step to the sealing process and requires special equipment beyond the normal threaded closure applying machines.

In U.S. Pat. No. 4,350,844 and U.S. application Ser. No. 728,377, filed Apr. 29, 1985, U.S. Pat. No. 4,613,052, having a common assignee with the present application, there is disclosed and claimed a screw type cap of plastic with a tamper-indicating ring or band that is carried at the lower end of the skirt of the closure with frangible bridges forming the connection. The removal of the closure results in the indicating band being severed from the closure and the band is moved to a lower position on the neck and is prevented from being returned to its, as applied, position. A container has a finish, below external threads which is formed with an inwardly and downwardly tapering side wall which leads to an abrupt, horizontal ledge such that when an indicating band is severed from a closure, on removal, the band falls below the ledge and cannot be returned. The closure is formed with internal threads in the skirt and at the bottom of the skirt a band or ring of about the same external diameter as the cap is formed with frangible bridges joining the band to the skirt. Within the indicating band an inwardly extending flexible stop ring is formed integral with the indicating band. A particular finish on the container provides a pair of radial ledges which extend outwardly below the threads on the container neck. These ledges are vertically displaced relative to each other and are joined by an inwardly tapering wall which is adapted to form the surface on which the stop ring will be seated when the closure is applied. The stop ring prevents removal of the closure without the separation of the indicating band from the closure skirt.

Among the objectives of the present invention are to provide a tamper indicating package wherein the tamper indicating band is positively caused to dropped away from the closure after being severed and an intermediate tapered or concave portion between the two beads so that a user can readily see and feel that the band has been severed.

In accordance with the invention, the tamper indicating package comprises a one-piece molded closure of plastic which threads onto a container such that when the closure is unthreaded, a tamper-indicating ring becomes separated from the lower end of the closure skirt. The indicating ring or band is joined to the closure along a weakened frangible line and a flexible stop ring is formed within the band and extends inwardly and upwardly when the closure is applied to a container finish. The container finish has a first radial bead, a second radial bead spaced axially below the first bead, and an intermediate tapered or concave surface between the first radial bead and second radial bead. A further surface extends from the second bead axially downwardly and radially inwardly and the flexible end of the stop ring rests on this surface between the two beads, when the closure is applied. When the closure is unthreaded to remove it, the free end of the stop ring passes over the second bead into the recess formed by the surface between the two beads and the frangible portion is broken leaving the ring and band in this position. Upon subsequent reapplication of the closure, the closure skirt engages the band causing the band to pass over the second bead on the finish so that the band falls away but remains on the container to indicate that the band has been severed.

DESCRIPTION

Figure 1:
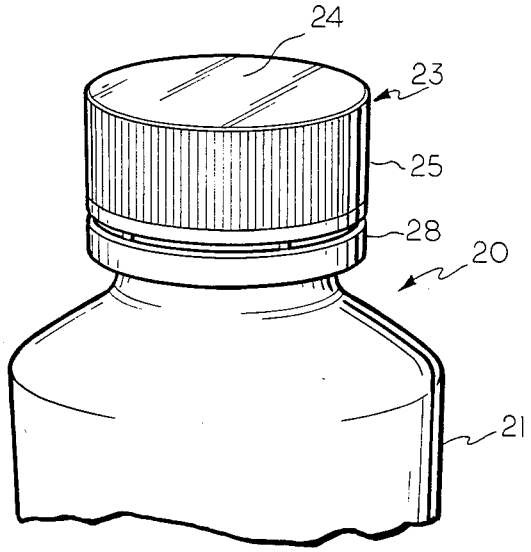
FIG. 1 is a fragmentary perspective view of the tamper indicating package embodying the invention.

Referring to FIGS. 1–8, the tamper indicating package 20 embodying the invention comprises a glass container 21 having a finish or neck 22. A closure 23 is formed of a thermoplastic material, such as polypropylene, molded as a single unit and comprises a generally disc-shaped base 24 and a cylindrical depending skirt 25. The inner surface of skirt 25 is formed with threads 26 which are adapted to engage complementary threads 27 on finish 22. An integral tamper indicating band 28 extends downwardly from skirt 25. Band 28 is generally cylindrical and has essentially the same external diameter as that of the skirt 25 of the closure 23. The band 28 is joined to the lower end of the skirt 25 by a plurality of frangible bridges 29. In addition, circumferentially spaced stops 30 are formed integral with the band 28 and are primarily for use when the closures are molded so as to permit the pushing of the molded closure from the mold die without compressing the frangible bridges 29, yet permit the removal of the closure with attached indicator band 28. Stops 30 are not attached to the lower skirt of the closure in any way.

Figure 2:
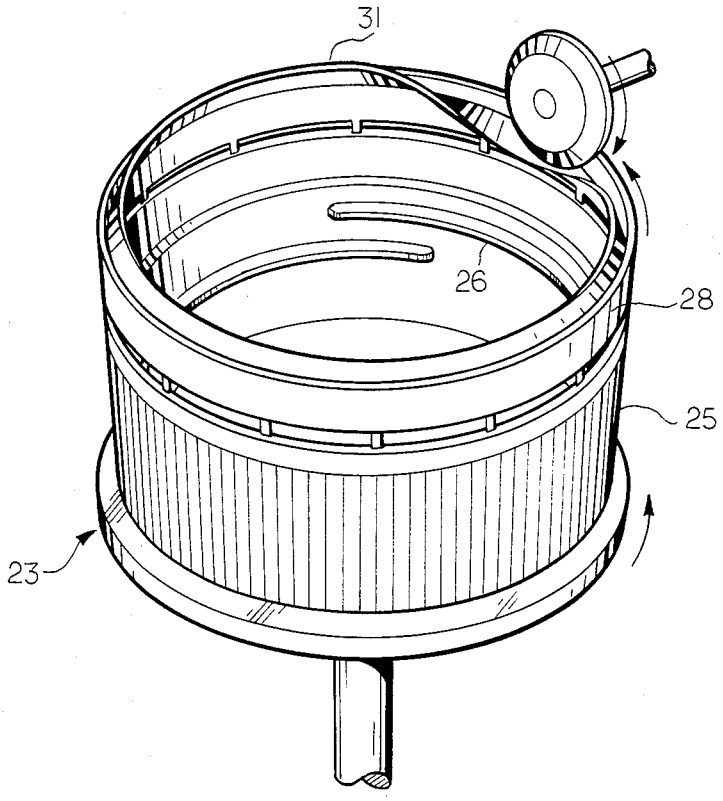
FIG. 2 is a perspective view of the cap of the invention in inverted position illustrating a post forming operation thereon.

An integrally formed annular stop ring 31 extends from the inner surface of band 28. When the cap is initially formed, it will take the configuration shown in FIG. 2. With the stop ring 31 in the inverted form shown in FIG. 2, the stop ring will extend inwardly and upwardly relative to the indicator band 28 with an included angle of approximately 30° C. As perhaps can be best seen in FIGS. 6 and 7, the stop ring 31 is integrally formed on the indicator band 28 and has a free end 32 of somewhat thicker configuration than the thickness of the connection between the ring 28 and band 25. After the closure 23 is molded in the shape illustrated in FIG. 2, the closure 23 is rotated about its central vertical axis, parallel to the cylindrical skirt and, at the same time, the stop ring 28 is engaged by a beveled rotating wheel 33. Wheel 33 is shown as being mounted on a shaft 34, it being understood that the shaft 34 is driven by any suitable drive means. Furthermore, as shown in FIG. 2, the closure 23 is depicted as being positioned on a rotating pad 35 carried at the upper end of a shaft 36. With the closure being rotated on the pad 35 and the wheel 33 rotating in engagement with the stop ring 31, the stop ring 31 is forced to bend downwardly and inwardly in the inverted position of the cap, as shown in FIG. 2, with the stop ring 31 being pushed through an angle of approximately 120° from the "as-molded" angle.

The tucking of the ring 31 into the position illustrated is made possible by the fact that it is joined to the inner surface of the band 28 by a thin section 36 which serves as a hinge. This is clearly illustrated in FIGS. 3–8 where the locking ring is hingedly formed integrally with a cylindrical portion of a tamper indicating band.

It should be understood that the ring 31 may be moved into the "tucked" position shortly after the molding operation before the plastic sets or at any time thereafter prior to being used with the container-closure combination. The ring will assume the "tucked" position when physically moved into this position and will remain in the position unless returned physically to the "as-molded" position illustrated in FIG. 2. The "tucking" or untucking of the ring does not require any heating of the plastic and may be carried out with the plastic at room temperature. When the ring in its "as-molded" position, it will remain in that position until being physically hinged inwardly. Thus, the ring position is "bistable". This is because the diameter formed by the inner edge or free edge of the ring is smaller than the diameter of the circle where the ring is joined to the wall portion of the band. This results in stability in either position on opposite sides (up or down) of a horizontal plane passing normal to the band 28 at the point of attachment of the ring 31 to the band 28. When the ring 31 is being moved from one stable position to the other, it will be placed under compressive stress until it passes over dead center, at which time it will relieve these stresses by assuming the stable position on the other side of the horizontal plane. One way of moving the locking ring, such as ring 31, from its as-molded position to the locking or tucked position is by pushing the inner edge of the ring down at one area in its circumference with the thumb and progressively pushing down the adjacent areas until the full circumference has been pushed down below the top edge of the band. Another method of moving the locking ring into locking position from its as-molded position would be by engaging the ring with a beveled wheel while rotating the band about its central axis as described above. This latter method is illustrated in U.S. patent application Ser. No. 728,377, filed Apr. 29, 1985, where a ring is attached to the lower skirt of a closure.

Figure 3:
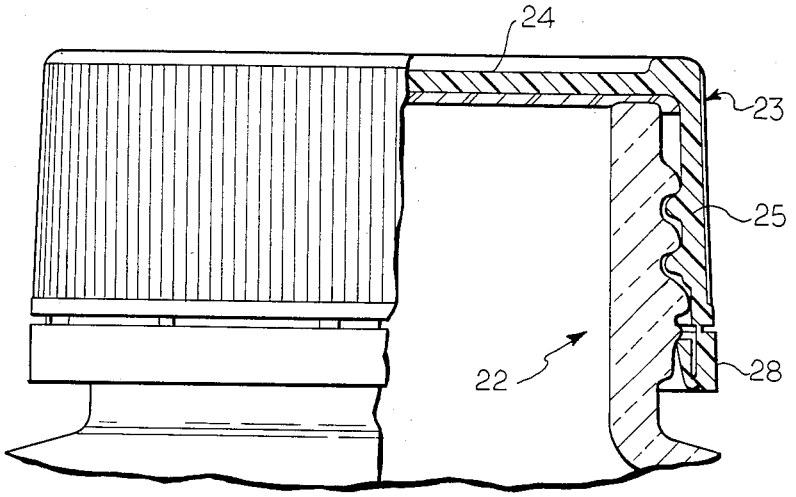
FIG. 3 is an enlarged part sectional side elevational view of the cap and container finish combination of FIG. 1 with the cap in the partial section and threaded onto the container finish.

The finish 23 of the container 21, as best seen in FIG. 3, has a first or upper radially outwardly curved bead 37 formed therein which extends outward to an extent somewhat greater than the external dimensions of the threads 27. The bead 37 has a lower surface 38 which may be termed a breaker ledge. As shown in FIG. 3, when the closure 23 is threaded down over the container finish 22, the stop ring 31 will have its free end 32 positioned beneath the second bead 38 and either in engagement with or closely spaced beneath the breaker surface 38. The finish 22 of the container 21 is also formed with a second radial bead 39 which is below the bead 37 and has a smaller diameter than bead 37 and its breaker ledge 38. The bead 39 extends inwardly as well but has its outer largest diameter connected to the first bead 37 by an intermediate annular concave groove or recess 40.

The finish is provided with an annular surface 41 that extends axially downwardly and radially inwardly from the second bead 39. As shown, the surface 39 is concave in cross section.

Figure 4:
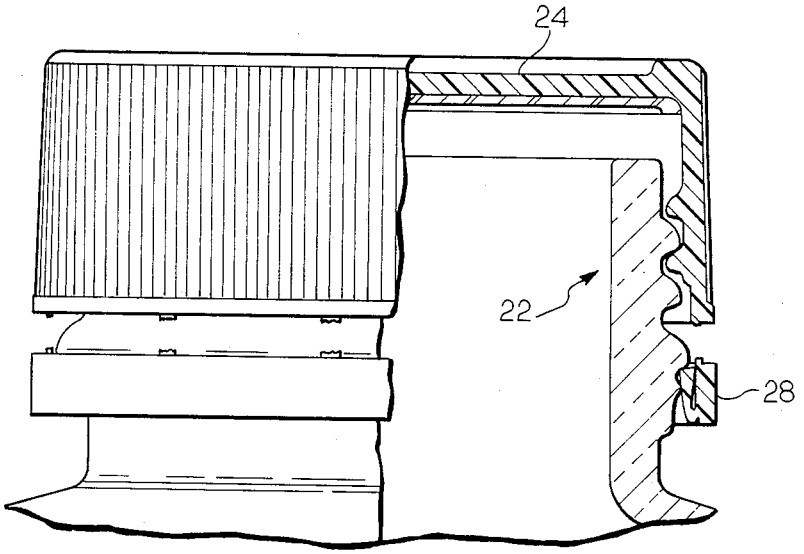
FIG. 4 is a view similar to that of FIG. 3 after the cap has been partially removed.
Figure 5:
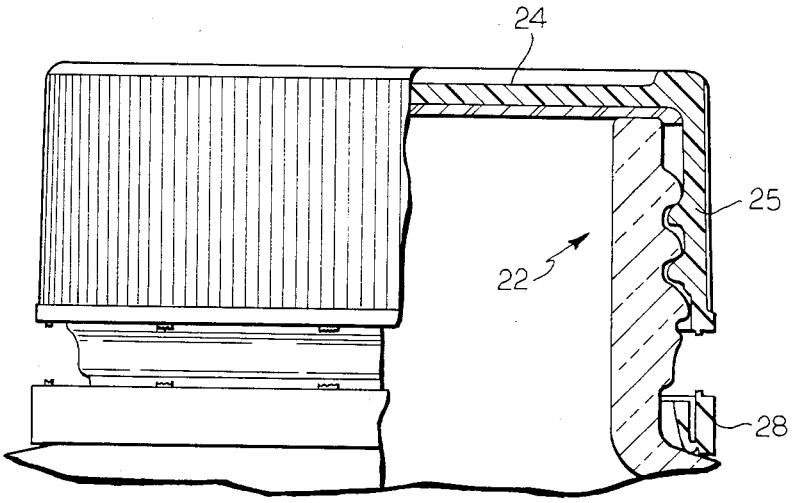
FIG. 5 is a view similar to that of FIG. 4 showing the position of the lower edge of the cap when it is fully reapplied on the container finish.
Figure 6:
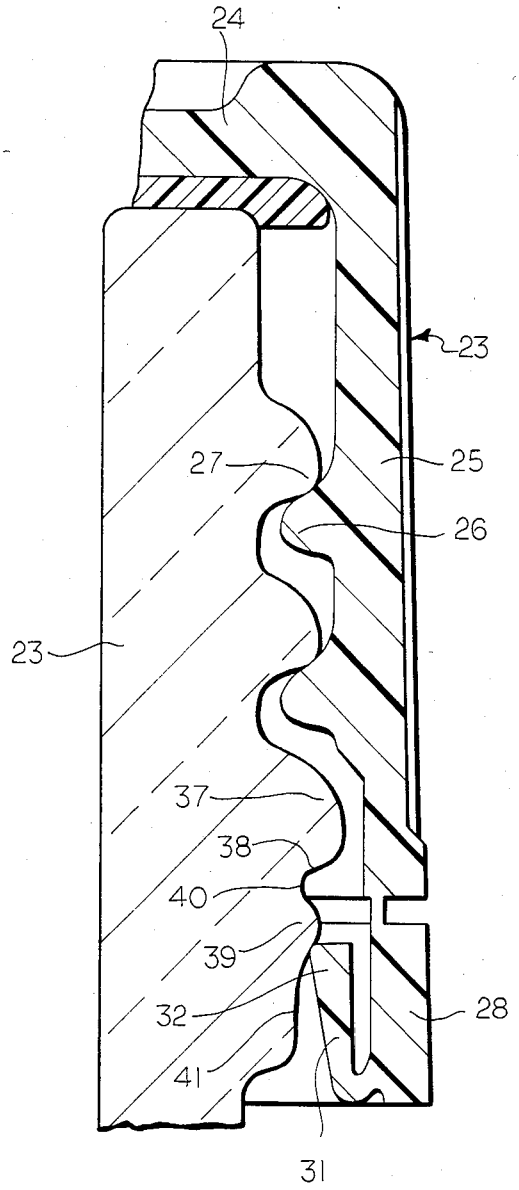
FIG. 6 is a fragmentary enlarged sectional view of a portion of the cap and container shown in FIG. 3.
Figure 7:
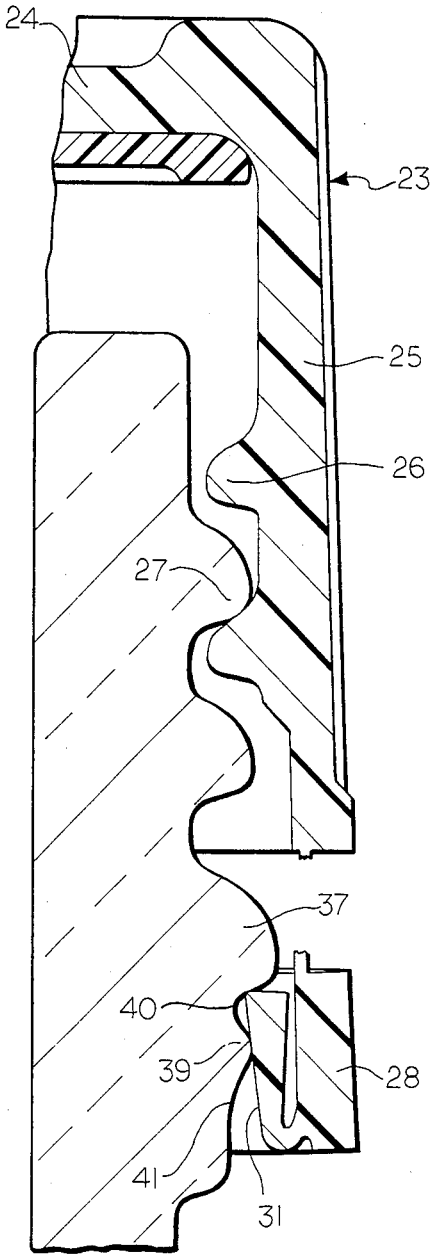
FIG. 7 is a fragmentary enlarged sectional view of a portion of the package shown in FIG. 4.
Figure 8:
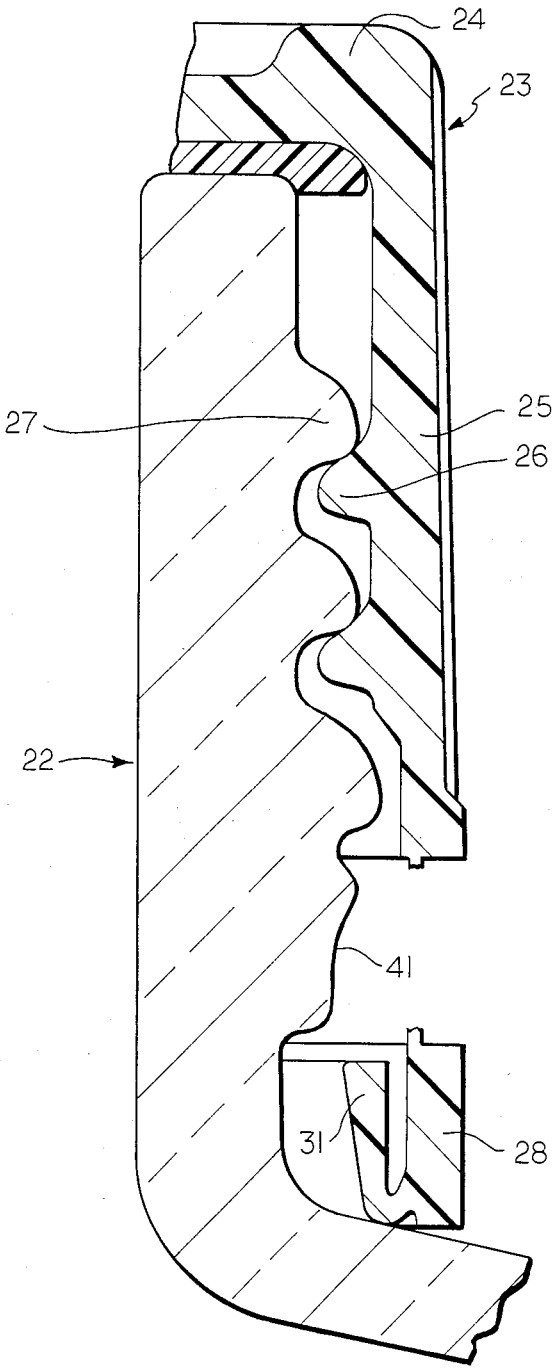
FIG. 8 is a fragmentary sectional view of a portion of the package shown in FIG. 5.
Figure 9:
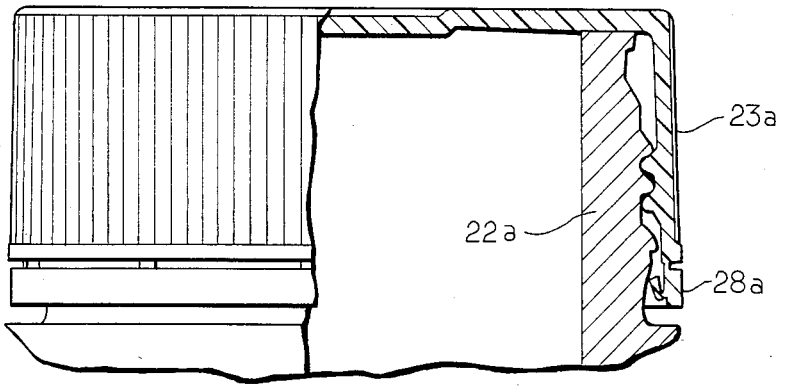
FIG. 9 is a fragmentary part sectional side elevational view of a modified form of package.
Figure 10:
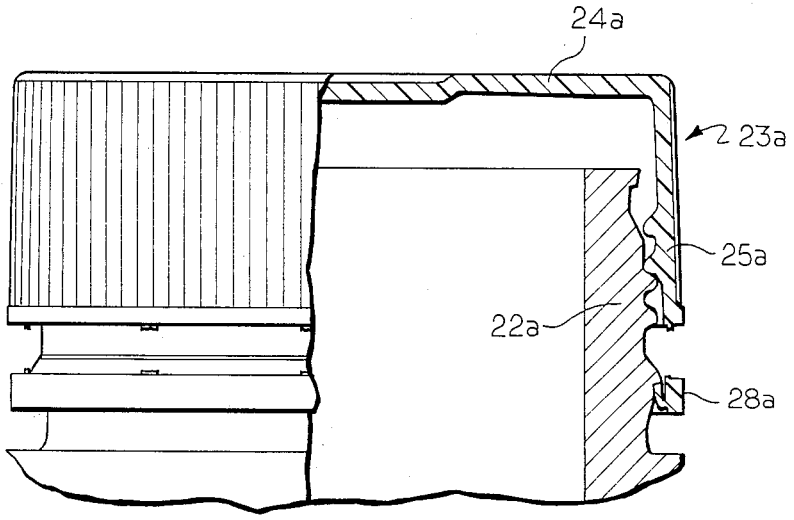
FIG. 10 is a view similar to FIG. 9 after the cap has been removed.
Figure 11:
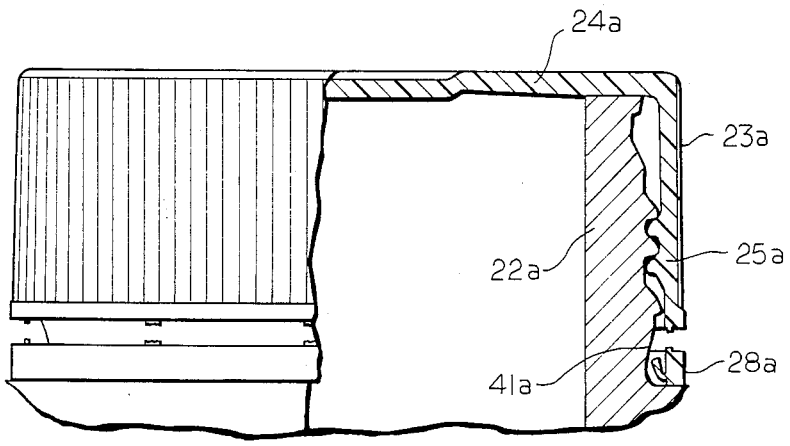
FIG. 11 is a view similar to FIG. 10 showing the relative position of the cap when it is reapplied to the container.
Figure 12:
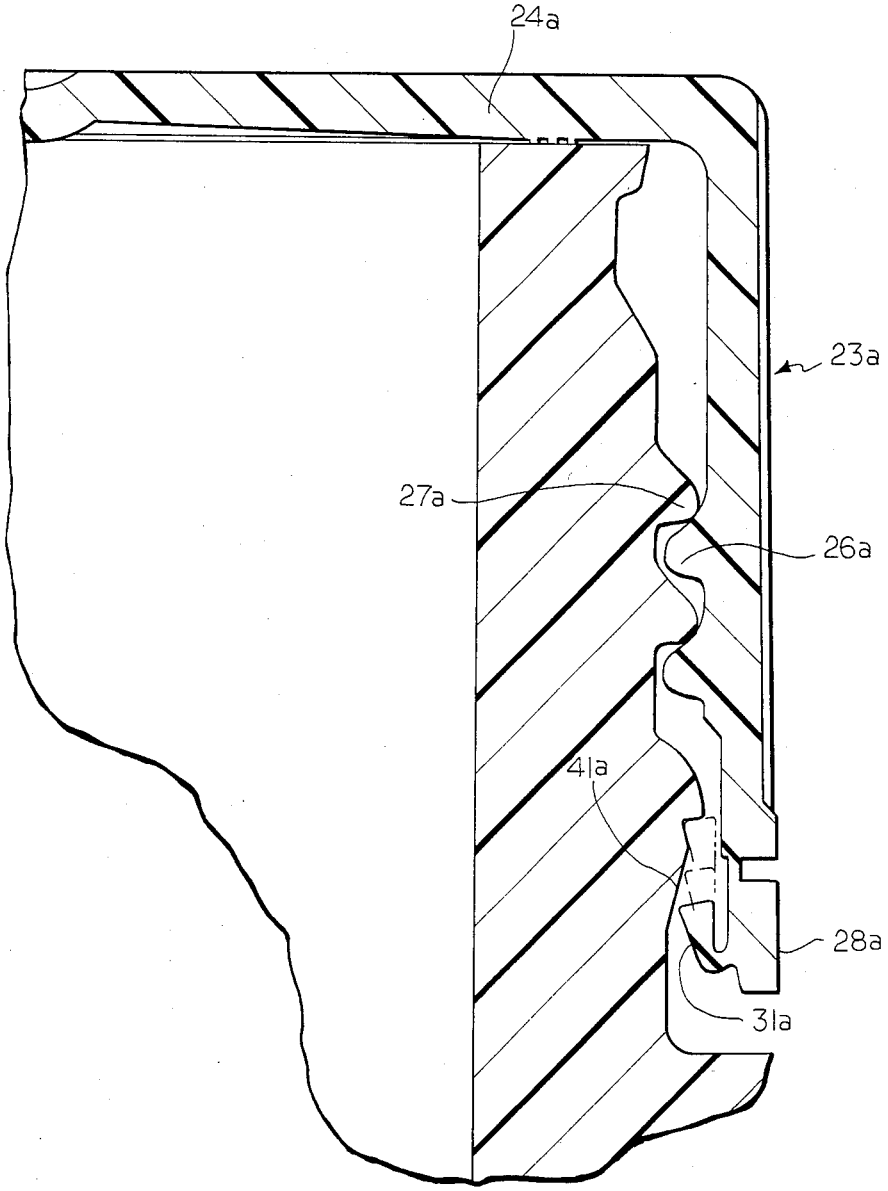
FIG. 12 is a fragmentary view on an enlarged scale of a portion of the package shown in FIG. 9.

As can readily be seen when viewing FIG. 3, when the closure is applied, the free end 32 of the ring 31 flexes outwardly successively over the first bead 36 and second bead 39 and engages the surface 41. When the closure 23 is unthreaded, skirt 25 carries band 28 and ring 31 axially outwardly causing the free end 32 of ring 31 to flex outwardly over second bead 38 and then flex inwardly bringing the free end 32 of the stop ring 31 beneath the breaker surface 39 of the bead 37. The moving or unthreading of the closure 12, as illustrated in FIGS. 4 and 7, results in the breaking of the bridges 29 since the stop ring 31 cannot move above the bead 37. Thus, after the bridges 29 are broken, the indicator band 28 and the stop ring 31 have its free end 32 remaining between the bead 37 and bead 39 of the container 21.

When the threaded closure is removed from the container finish, the stop ring 31 will be prevented from passing back over the bead 37 by the engagement of the end 32 of the stop ring 31 with the ledge 38 of the bead 37 (FIGS. 4, 7).

After the closure has been unthreaded, the stop ring 20 will be prevented from moving downwardly by engagement of the free end 32 of ring 31 with the groove or recess 40 (FIGS. 4, 7).

When the closure is reapplied, the free edge of the skirt 25 engages the band 28 and moves it downwardly causing the ring 31 to flex over bead 39 so that the band falls away but remains on the container to indicate that the band has been severed.

In the form of the invention set forth in FIGS. 9–12, the container 21*a* is made of plastic such as polyethylene or polypropylene. To accommodate manufacturing procedures such as blow molding, the second surface 41*a* is made straight in axial cross section. In all other respects, the container 21*a* and closure 23*a* are similar to the form shown in FIGS. 1–8. Accordingly, similar parts are marked with similar reference numerals with the suffix "a".

We claim:

1. A tamper indicating package comprising:

a container having a finish having a free end, a closure comprising a base wall and a peripheral skirt, a tamper indicating band connected to the skirt along a weakened frangible line, a stop ring flexibly connected to said band and extending radially inwardly and axially toward the base wall of the closure, said finish and said closure having interengaging means which are engageable and disengageable by relative rotation between the closure and containers, said finish having a first annular bead, a second annular bead spaced axially from said first annular bead, a first surface defining a recess between said beads, and a second surface extending from said second bead radially inwardly and axially away from the free end of the finish, said stop ring normally engaging the second surface when said closure is engaged with said container such that when the closure is rotated to remove the closure from the container, said stop ring is moved axially and flexes over the second bead bringing the free end of the stop ring into engagement with said first bead and continued relative rotation of the closure causes the band to be severed along the weakened line leaving the band with the free end of the stop ring in said recess, and when the closure is reapplied to the container, the free edge of said skirt engages said stop ring to move the ring out of engagement with the recess and force the ring to fall away from the skirt.

2. The package set forth in claim 1 wherein said second surface is concave in axial cross section.

3. The package set forth in claim 2 wherein said container is made of glass.

4. The package set forth in claim 1 wherein said second surface is straight in axial cross section.

5. The package set forth in claim 4 wherein said container is made of plastic.

6. The package set forth in claim 1 wherein said second bead has a leser diameter than said first bead.

* * * * *